US007018228B2

(12) United States Patent
Patterson

(10) Patent No.: US 7,018,228 B2
(45) Date of Patent: Mar. 28, 2006

(54) ELECTRICAL CONNECTOR WITH A LOW PROFILE LATCH

(75) Inventor: Jeremy Christin Patterson, Mcleansville, NC (US)

(73) Assignee: Tyco Electronics Corporation, Middleton, PA (US)

( * ) Notice: Subject to any disclaimer, the term of this patent is extended or adjusted under 35 U.S.C. 154(b) by 58 days.

(21) Appl. No.: 10/705,790

(22) Filed: Nov. 10, 2003

(65) Prior Publication Data

US 2005/0101178 A1 May 12, 2005

(51) Int. Cl.
*H01R 13/627* (2006.01)

(52) U.S. Cl. ..... 439/350

(58) Field of Classification Search ..... 439/350, 439/351, 356, 357, 358
See application file for complete search history.

(56) References Cited

U.S. PATENT DOCUMENTS

| | | | | |
|---|---|---|---|---|
| 3,475,718 | A * | 10/1969 | Hartz et al. | 439/357 |
| 5,254,014 | A * | 10/1993 | Yagi et al. | 439/353 |
| 6,514,099 | B1 * | 2/2003 | Endo | 439/489 |
| 6,857,893 | B1 * | 2/2005 | Patterson | 439/385 |
| 2002/0119693 | A1 * | 8/2002 | Chen | 439/358 |

* cited by examiner

*Primary Examiner*—Phuong Dinh

(57) ABSTRACT

An electrical connector includes housing having a mating face that is configured to be mounted onto an electrical connector interface. A latch assembly is provided on a side wall of the housing. The latch assembly is oriented to extend along the side wall. The latch assembly has a latch element formed on an end thereof proximate the mating face, and includes mounting brackets separated from one another along a length of the latch assembly. The mounting brackets join the latch assembly to the side wall. The latch assembly has a portion between the mounting brackets that is deflectable toward the side wall.

19 Claims, 5 Drawing Sheets

ELECTRICAL CONNECTOR WITH A LOW PROFILE LATCH

BACKGROUND OF THE INVENTION

The present invention relates generally to electrical connectors and particularly to an electrical connector with a low profile latch.

Electrical connectors have been proposed with various features to afford secure mechanical and electrical engagement with a mating electrical connector or other mateable connecting device. Various latching systems have been used with electrical connectors to provide such secure engagement. It is desirable that the latch providing the secure engagement also afford easy attachment and detachment. For instance, latching mechanisms have been developed which include pivotally supported latching arms that interlock with each other or that interlock with a complementary latching mechanism of the mateable connector or connecting device. The latching arms of many connectors are pivotally mounted on the connector housings and often require a relatively long lever arm portion to pivot the latching arm to either engage or disengage the arm from a latch on the mating connecting device. This requires considerable space on the connector assembly which renders such connectors unsuitable for spatially constrained applications such as seat motor interfaces in automobiles.

In the automotive industry, heretofore, space constraints have prevented the use of a releasable latch at the connector that joins the seat electronics to the vehicle. Hence, seat connectors have employed a non-serviceable connection whereby the primary connector, once mated, is not intended to be disconnected. This usually results when space constraints render the primary connector either totally inaccessible or where there is not sufficient space for the connector to be manipulated as needed to perform a disconnect without damaging the connector. In such applications, a secondary connection has been provided in a manner and location that is serviceable. The secondary connection can be disconnected to accommodate service and repair activities. Secondary connections are provided in applications where space is limited, such as in automotive seat applications. More specifically, the seat adjusting mechanism is driven by an electric motor which can only be serviced after removing the seat. Due to space limitations, a secondary serviceable connection is typically used to facilitate the removal of the seat. However, the use of secondary connections adds to product cost.

A need exists for a connector with a low profile latch for use in applications with close space constraints such as seat motor connections.

BRIEF DESCRIPTION OF THE INVENTION

In one aspect of the invention, an electrical connector includes a housing having a mating face that is configured to be mounted onto an electrical connector interface. A latch assembly is provided on a side wall of the housing. The latch assembly is oriented to extend along the side wall. The latch assembly has a latch element formed on an end thereof proximate the mating face, and includes mounting brackets separated from one another along a length of the latch assembly. The mounting brackets join the latch assembly to the side wall. The latch assembly has a portion between the mounting brackets that is deflectable toward the side wall.

In another aspect of the invention, an electrical connector includes a housing having a mating face that is configured to join an electrical connector interface. A shroud is provided on a side wall of the housing. The shroud has an outer flange spaced from the side wall to define a gap therebetween. A latch assembly is pivotally provided on the side wall and is oriented to extend along the side wall. The latch assembly has a latch element formed on an end thereof proximate the mating face. At least a forward portion of the latch assembly is located within the gap and is pivotal between the shroud and the side wall.

DETAILED DESCRIPTION OF THE INVENTION

Figure 1:
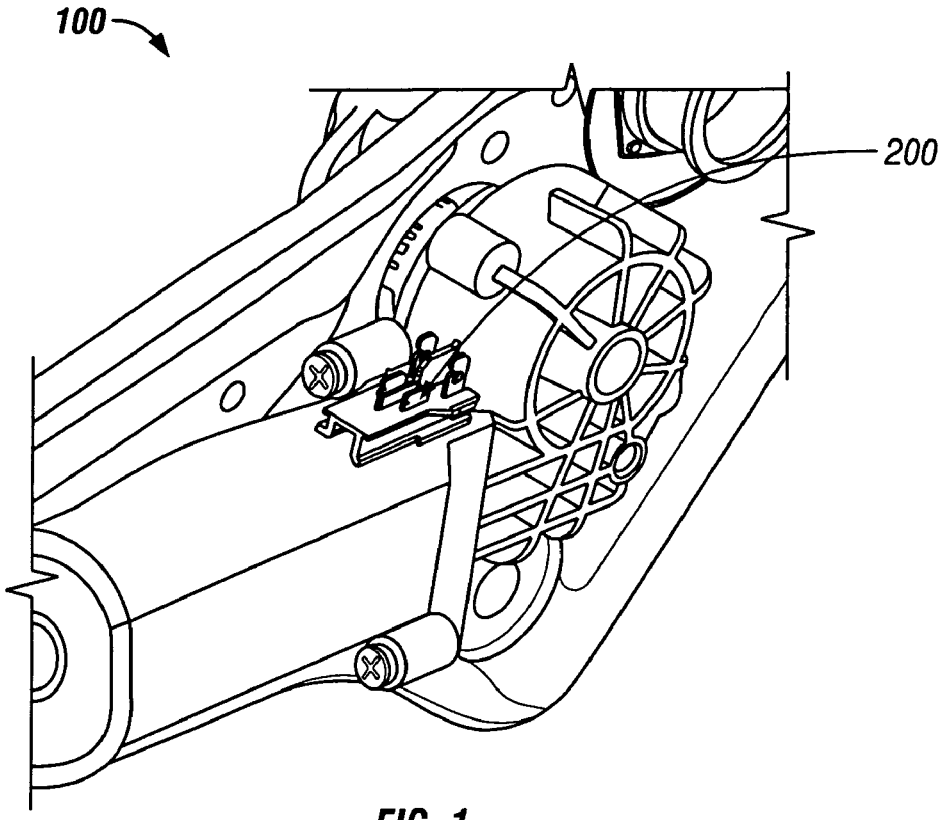
FIG. 1 (Prior Art)
FIG. 1 is a partial perspective view of a seat motor for an automotive application.

FIG. 1 illustrates a seat motor 100 that is a height adjust motor and is used in an area of limited space on an automobile. Seat motor 100 includes a connector interface 200.

Figure 2:
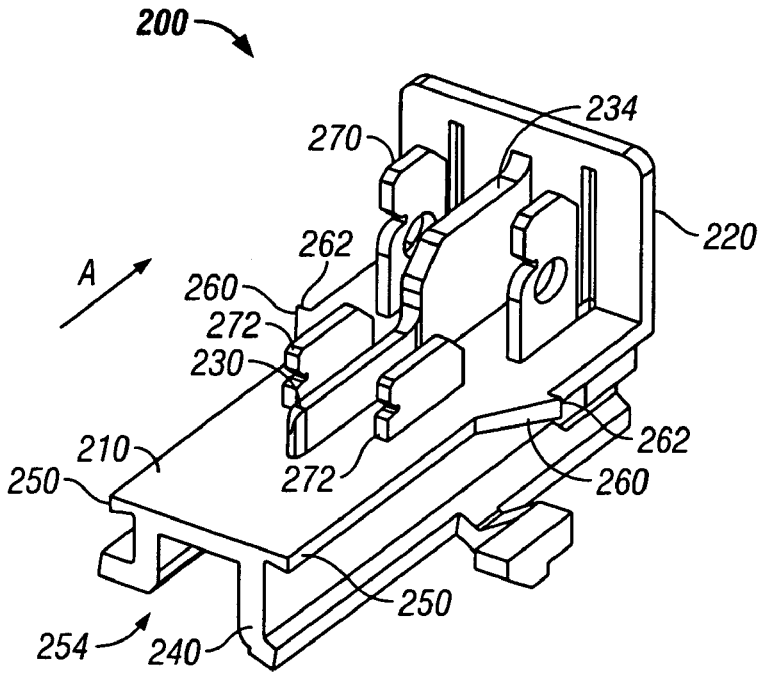
FIG. 2 (Prior Art)
FIG. 2 is a perspective view of an electrical interface for the seat motor of FIG. 1.

FIG. 2 shows the connector interface 200 in greater detail which includes a base 210, a back wall 220, a support rib 230 centrally located on base 210 and an alignment rib 234 between the support rib 230 and the back wall 220. A pair of contacts 270 upwardly extend from base 210 proximate back wall 220. Additional contacts 272 are centrally positioned and upwardly extend from the base 210. Base 210 has flanges 260 outwardly projecting from each side thereof. Flanges 260 include a forward facing latching surface 262. Base 210 includes wing portions 250 on each side that extend from a rearward end 254 of the base 210 to the flange 260. For purposes of illustration, the term forward shall refer to a direction denoted by arrow A from the rear end 254 toward back wall 220 of connector interface 200. The connector interface 200 includes rails 240 that sit on the seat motor 100.

Figure 3:
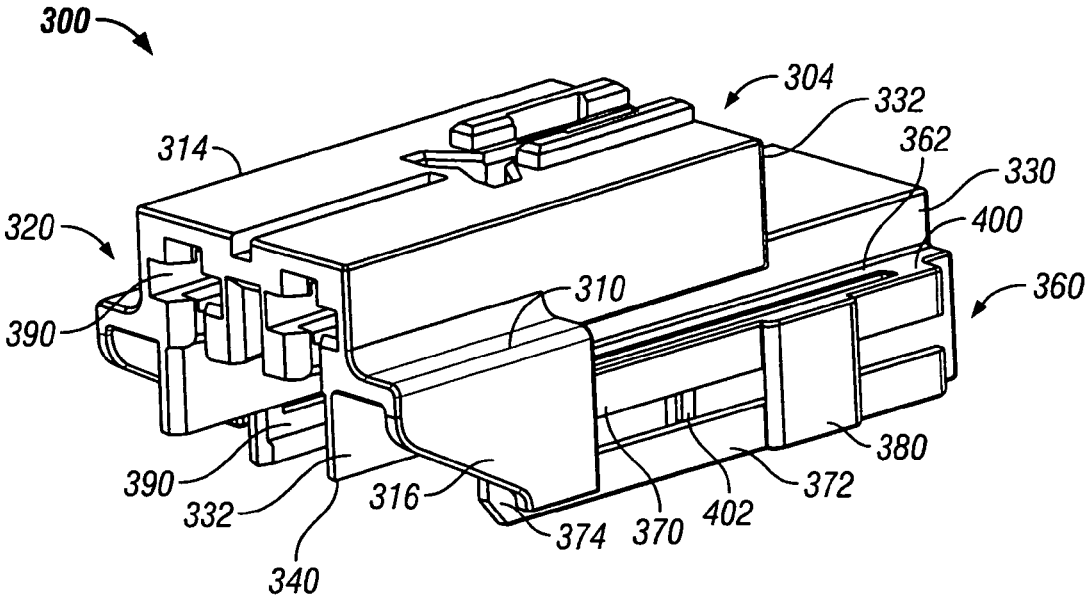
FIG. 3 is a front perspective view of an electrical connector formed in accordance with an embodiment of the present invention to join the electrical interface shown in FIG. 3.

FIG. 3 illustrates a connector 300 formed in accordance with an embodiment of the present invention for use with connector interface 200. The connector 300 has a mating face 320 and includes a housing 304 formed with a top wall 314, upper side walls 332, and lower side walls 330. A shroud 310 extends laterally from each of upper side walls 332 proximate the connector mating face 320. The outer portion of shroud 310 folds down to form a flange 316. The connector mating face 320 includes a number of contact cavities 390. The connector mating face 320 is configured to join the connector interface 200 (FIG. 2) such that contact cavities 390 accept the contacts 270 and 272. The contact cavities 390 include contacts (not shown) that join contacts 270 and 272. The lower edges 340 of lower walls 330 may rest on the base 210 when the connector is joined with the connector interface 200.

A latch assembly 360 is attached to one or each of side walls 330 of connector 300. The forward end of the latch assembly 360 is below shroud 310. Each latch assembly 360 is oriented with a longitudinal axis of the latch assembly 360 extending along a length of the side wall 330. The latch assembly 360 includes parallel upper and lower beams 370 and 372 which extend along the side wall 330. A rear mounting bracket 400 joins upper and lower beams 370 and 372 to the side wall 330 through a base plate 362. Intermediate portions of the upper and lower beams 370 and 372 are joined to the side wall 330 through an intermediate mounting bracket 402 and the base plate 362. The shroud 310 and flange 316 overlap a forward portion of latch assembly 360. The shroud 310 and flange 316 operate to provide overstress protection at the forward portion of the latch assembly 360.

Figure 4:
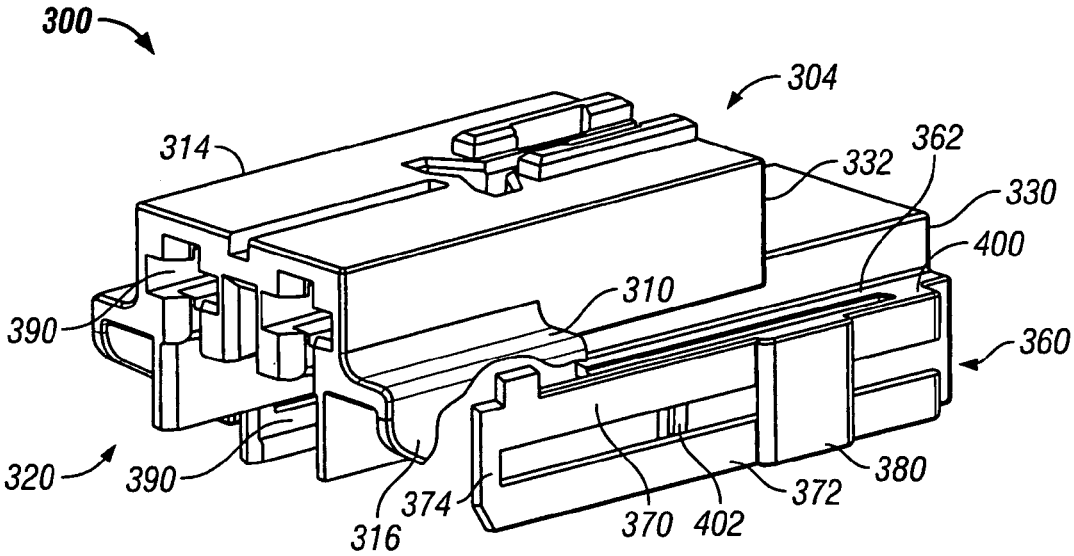
FIG. 4 is a view of the connector of FIG. 3 with a cut away showing latch assembly detail.

In FIG. 4, the flange 316 is cut away to illustrate a latch element 374 at the forward end of latch assembly 360. The upper and lower beams 370 and 372 have lead ends that are joined proximate the connector mating face 320 by a cross bar. The cross bar forms the latch element 374 that engages flanges 260 and latching surfaces 262 on the base 210 when the connector 300 is joined to the connector interface 200. A grip element 380 is centrally positioned between rear and intermediate mounting brackets 400 and 402 connecting upper and lower beams 370 and 372.

Figure 5:
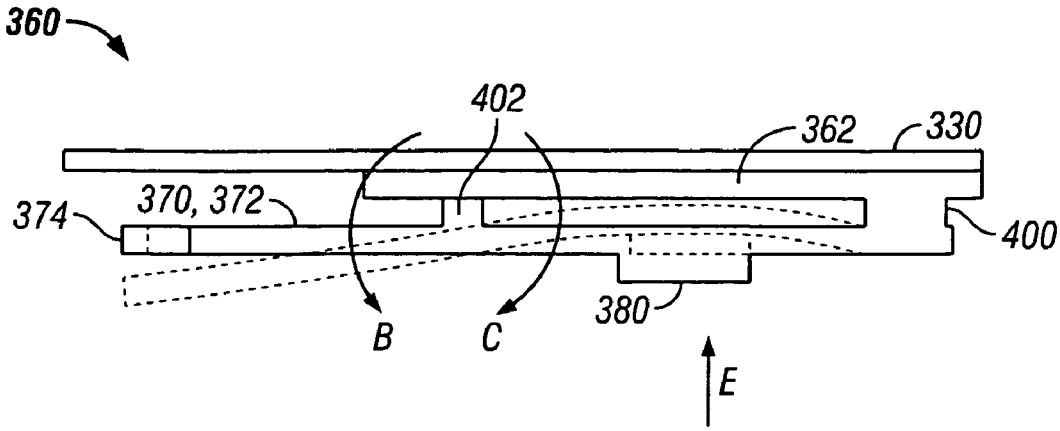
FIG. 5 is a top view of a latch assembly from the connector of FIG. 3.
Figure 6:
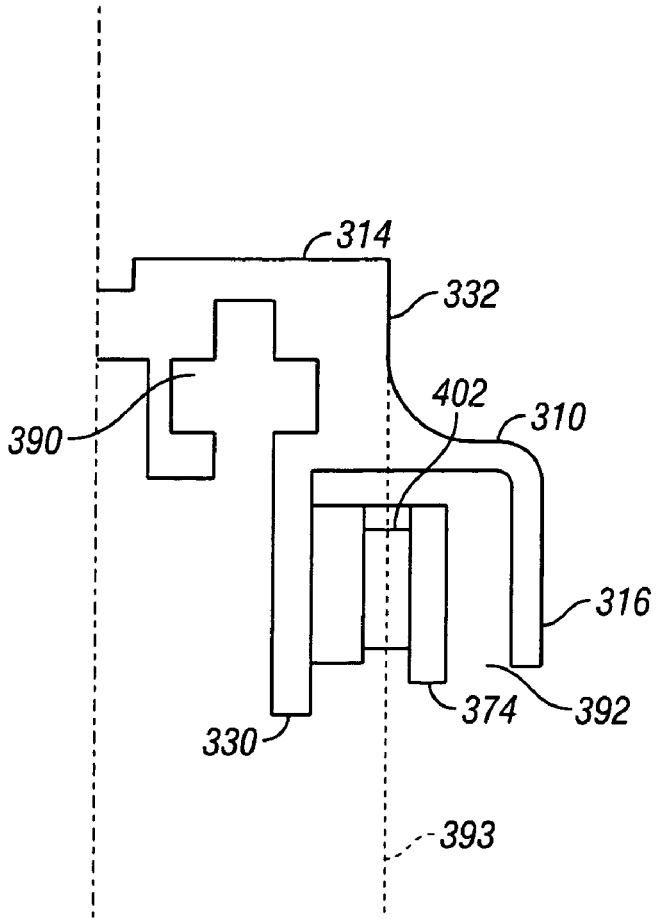
FIG. 6 is a partial front view of the mating face of the connector of FIG. 3.

The attachment and operation of the latch assembly 360 is shown with reference to FIGS. 5 and 6. The latch assembly 360 attaches to the housing lower side wall 330 through a base plate 362 and mounting brackets 400 and 402. Mounting brackets 400 and 402 provide attachments that are sufficiently rigid that shrouding or overstress protection features are not required in these areas. The latch assembly 360 is operated by applying inward lateral pressure on grip element 380 in the direction of arrow E which results in the deflection of beams 370 and 372 as indicated in dashed lines. Pressure at grip element 380 causes the span of beams 370 and 372 between the rigid mounting brackets 400 and 402 to deflect inward. The inward flexing of the beams 370 and 372 between the mounting brackets 400 and 402 causes the forward ends of the beams 370 and 372, along with latch element 374, to move outward. The forward ends of the beams 370 and 372 with latch element 374 pivot laterally outward and inward about the intermediate mounting bracket 402 in the direction of arrows B and C as pressure is applied and removed from the grip element 380.

As best shown in FIG. 6, the upper shroud 310 and flange 316 extend outward and down from side wall 330 to create a latch operating gap 392. The upper and lower beams 370 and 372 pivot within gap 392 over a range of movement limited by side wall 330 and flange 316. Grip portion 380 is normally biased away from the side wall 330 in a neutral position between the mounting brackets 400 and 402 when no activating pressure is applied. Inward pressure on grip portion 380 moving grip portion 380 toward side wall 330 causes the upper and lower beams 370 and 372 to move the latch element 374 outward away from the side wall 330 to a released position. The forward ends of beams 370 and 372 with latch element 374 pivot within gap 392 about a rotational axis 393 (FIG. 6) through pivot post 402. The rotational axis 393 extends transversely through latch assembly 360 at an intermediate point along the length of the latch assembly 360. Gap 392 is oriented perpendicularly to the rotational axis 393.

Figure 7:
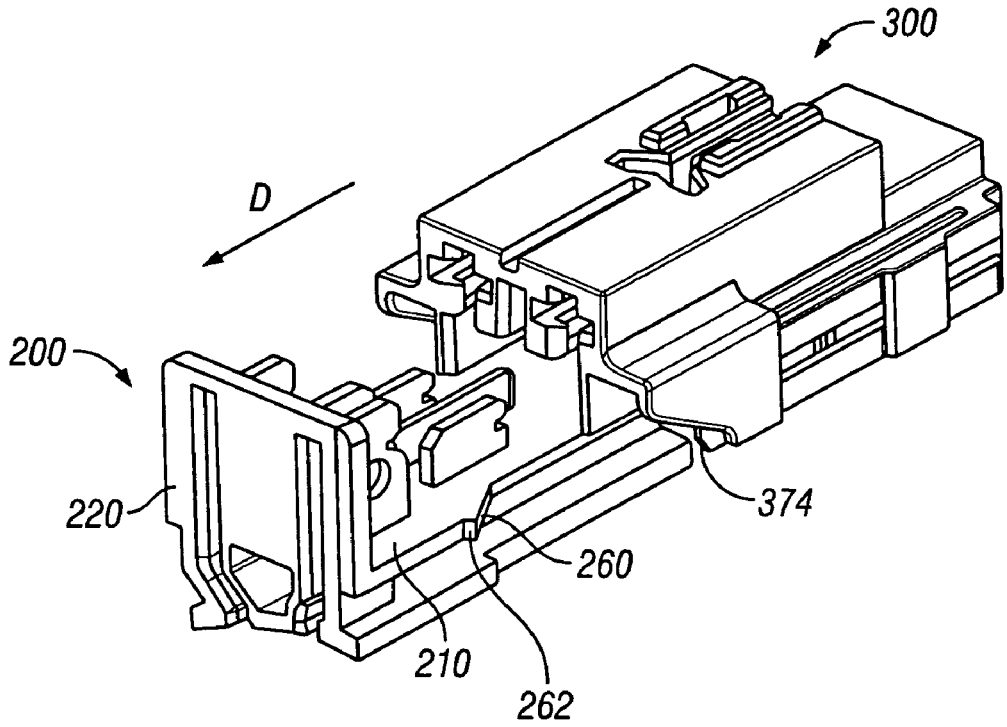
FIG. 7 is a perspective view of a connector unmated to a seat motor interface.
Figure 8:
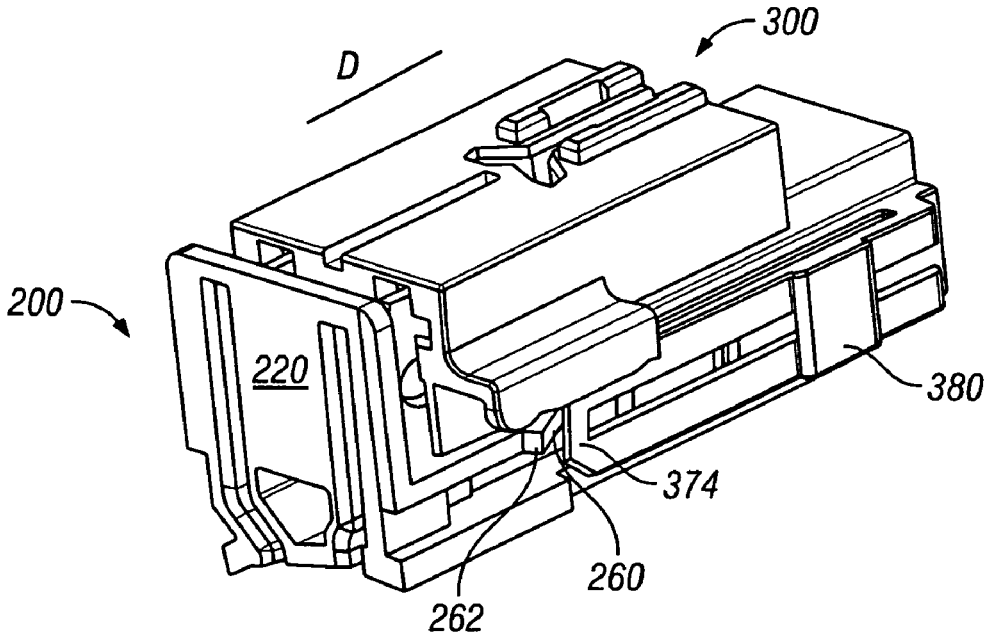
FIG. 8 is a perspective view of a connector partially mated to a seat motor interface.
Figure 9:
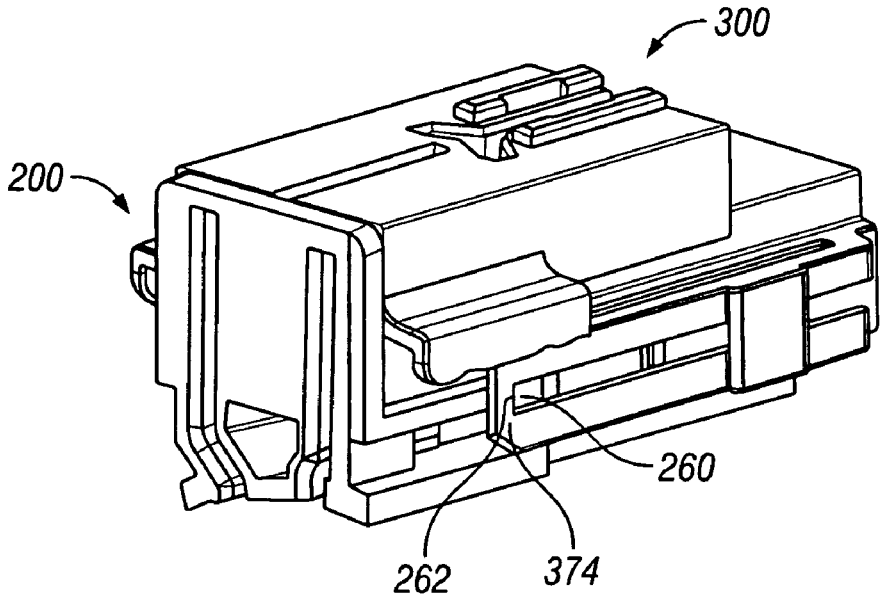
FIGS. 9 and 10 are perspective views of a connector fully mated to a seat motor interface.
Figure 10:
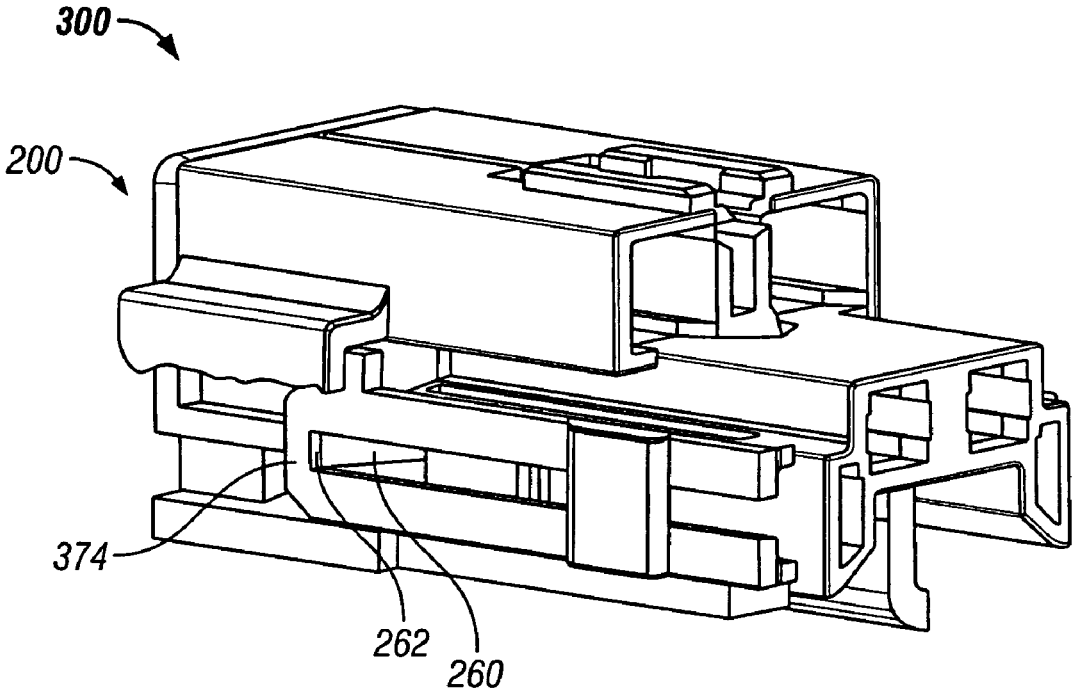

The mating operation of connector 300 with connector interface 200 is shown progressively in FIGS. 7 through 10 and discussed hereafter. In FIG. 7, connector 300 is positioned on base 210 of connector interface 200 at an initial position. Connector 300 is then advanced in the direction of arrow D (FIG. 7) toward back wall 220 of interface 200. At the point shown in FIG. 7, the connector 300 and connector interface 200 are unmated. In FIG. 8, connector 300 is sufficiently advanced that the latch element 374 contacts flange 260 on the base 210. At this point (FIG. 8), connector 300 and interface 200 are partially mated. However, latch element 374 is not fully engaged on the latching surface 262 of flange 260. In FIGS. 9 and 10, connector 300 is advanced until the cross bar 374 is fully engaged on the latching surface 262 of flange 260 at which position the mating operation is completed.

To separate connector 300 from interface 200, pressure is applied to grip portion 380 in the direction of arrow E (FIG. 5) which causes beams 370 and 372 to pivot in the direction of arrow B, thereby moving latch element 374 out of engagement with latching surface 262 on flange 260 (e.g., to a non-overlapping position with flange 260) thus allowing connector 300 to be withdrawn from interface 200.

The embodiments thus described provide a low profile electrical connector for use in limited space applications. The connector includes a releasable latch that facilitates disengagement of the connector while assuring positive engagement of the connector and connector interface when mated. The connector affords a serviceable primary connection eliminating the need for secondary serviceable connections for applications such as automotive seat motor connections.

While the invention has been described in terms of various specific embodiments, those skilled in the art will recognize that the invention can be practiced with modification within the spirit and scope of the claims.

What is claimed is:

1. An electrical connector, comprising:

a housing having a mating face that is configured to be mounted onto an electrical connector interface; and a latch assembly provided on a side wall of said housing, said latch assembly including cantilevered upper and lower beams extending along said side wall and mounting brackets separated from one another along a length of said latch assembly, said mounting brackets joining said latch assembly to said side wall, said latch assembly having a portion between said mounting brackets that is deflectable toward said side wall.

2. The electrical connector of claim 1, wherein said latch assembly includes rear and intermediate mounting brackets integrally joining said upper and lower beams, respectively, to said side wall.

3. The electrical connector of claim 1, wherein said latch assembly includes at least one cantilever beam projecting forward from said mounting brackets toward said mating face and a grip portion located between said mounting brackets.

4. The electrical connector of claim 1, wherein said latch assembly flexes between said mounting brackets to rotate said latch element toward and away from said mating face.

5. The electrical connector of claim 1, further comprising a shroud provided along at least a portion of said side wall, said shroud overlapping said end of said latch assembly including said latch element.

6. The electrical connector of claim 1, further comprising a shroud extending outward from said side wall, said shroud having a flange spaced apart from said side wall to define a latch operation gap therebetween, said latch assembly including a beam extending along said latch operation gap, said beam pivoting laterally within said latch operation gap.

7. The electrical connector of claim 1, wherein said latch assembly includes a pair of parallel beams having rear ends formed with a rear mounting bracket to said side wall, said beams being spaced apart from said side wall at an intermediate point by intermediate mounting brackets.

8. The electrical connector of claim 6, wherein said shroud is configured to limit a range of pivotal motion of said latch assembly.

9. The electrical connector of claim 1, wherein said latch assembly includes a beam that pivots inward and outward toward and away from said side wall, said connector further comprising a shroud extending beyond and partially covering said beam.

10. The electrical connector of claim 1, wherein said latch assembly includes a raised grip formed on said portion between said mounting brackets, said portion being normally biased outward away from said side wall, said portion being deflectable inward toward said side wall to release said latch element.

11. An electrical connector, comprising:

a housing having a mating face that is configured to join an electrical connector interface;

a shroud provided on a side wall of said housing, said shroud having an outer flange spaced from said side wall to define a gap therebetween; and a latch assembly pivotally provided on said side wall, said latch assembly being oriented to extend along said side wall, said latch assembly including art upper beam and a lower beam extending along said side wall, and a cross bar joining said upper and lower beam proximate said mating face, at least a forward portion of said latch assembly being located within said gap and being pivotal between said shroud and said side wall; and wherein said upper and lower beams are cantilevered alone said side wall and said latch assembly includes rear and intermediate mounting brackets integrally joining said and lower beams, respectively to said side wall, at least a forward portion of said upper and lower beams pivotally rotating transversely within said gap.

12. The electrical connector of claim 11, wherein said latch assembly includes an intermediate mounting bracket joining said latch assembly to said side wall, said latch assembly including at least one cantilever beam projecting forward from said intermediate mounting bracket toward said mating face and a grip portion located rearward from said intermediate mounting bracket.

13. The electrical connector of claim 11, wherein said forward portion of said latch assembly pivots about a rotational axis extending transversely through said latch assembly at an intermediate point along said length of said latch assembly, said forward portion laterally moving within said gap, said gap being oriented perpendicular to said rotational axis.

14. The electrical connector of claim 11, wherein said shroud has a flange spaced apart from said side wall to define said gap as a latch operation gap, said latch assembly including a beam extending along said latch operation gap, said beam pivoting laterally within said latch operation gap.

15. The electrical connector of claim 11, wherein said shroud does not overlap a rear portion of said latch assembly, said rear portion having a grip surface that is pressed toward said side wall to release said latch element.

16. The electrical connector of claim 11, wherein said shroud is configured to limit a range of pivotal motion of said latch assembly.

17. The electrical connector of claim 11, wherein said latch assembly includes a beam that pivots inward and outward toward and away from said side wall, said shroud extending beyond and partially covering said beam.

18. The electrical connector of claim 11, wherein said latch assembly includes mounting brackets joining said latch assembly to said side wall, said latch assembly having a portion between said mounting brackets, and a raised grip formed on said portion between said mounting brackets said portion being normally biased outward away from said side wall, said portion being deflectable inward toward said side wall to release said latch element.

19. An electrical connector, comprising:

a housing having a mating face that is configured to join an electrical connector interface;

a shroud provided on a side wall of said housing, said shroud having an outer flange spaced from said side wall to define a gap therebetween; and a latch assembly pivotally provided on said side wall, a length of said latch assembly extending along a length of said side wall, said latch assembly including an upper beam and a lower beam and mounting brackets separated from one another along a length of said latch assembly, said mounting brackets joining said latch assembly to said side wall, said latch assembly having a portion between said mounting brackets that is deflectable toward said side wall, said forward portion of said latch assembly rotating laterally within said gap about one of said mounting brackets when said portion of said latch assembly between said mounting brackets is deflected toward said side wall.

* * * * *

UNITED STATES PATENT AND TRADEMARK OFFICE

CERTIFICATE OF CORRECTION

PATENT NO. : 7,018,228 B2
APPLICATION NO. : 10/705790
DATED : March 28, 2006
INVENTOR(S) : Jeremy Christin Patterson It is certified that error appears in the above-identified patent and that said Letters Patent is hereby corrected as shown below:

Claim 11, line 9, delete “art” and substitute --an--.

Claim 11, line 11, delete “beam” and substitute --beams--.

Claim 11, line 18, delete “and lower beams” and substitute --upper and lower beams,--.

Signed and Sealed this

Twenty-fifth Day of July, 2006

JON W. DUDAS
*Director of the United States Patent and Trademark Office*